US009618311B2

(12) United States Patent
Hayashi et al.

(10) Patent No.: US 9,618,311 B2
(45) Date of Patent: Apr. 11, 2017

(54) METHOD FOR BLASTING OBJECT TO BE TREATED IN PRESSURE VESSEL

(71) Applicant: Kobe Steel, Ltd., Hyogo (JP)

(72) Inventors: Koichi Hayashi, Hyogo (JP); Takao Shirakura, Tokyo (JP); Kiyoshi Asahina, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 147 days.

(21) Appl. No.: 14/371,602

(22) PCT Filed: Jan. 22, 2013

(86) PCT No.: PCT/JP2013/000287
§ 371 (c)(1),
(2) Date: Jul. 10, 2014

(87) PCT Pub. No.: WO2013/118434
PCT Pub. Date: Aug. 15, 2013

(65) Prior Publication Data

US 2014/0352522 A1 Dec. 4, 2014

(30) Foreign Application Priority Data

Feb. 6, 2012 (JP) ..... 2012-023123

(51) Int. Cl.
*F42D 5/04* (2006.01)
*F42B 33/06* (2006.01)
(Continued)

(52) U.S. Cl.
CPC ..... *F42D 5/04* (2013.01); *B30B 1/001* (2013.01); *C21D 7/10* (2013.01); *C21D 9/0068* (2013.01);
(Continued)

(58) Field of Classification Search
CPC ..... F42D 5/04; F42D 5/045; F42D 3/00
(Continued)

(56) References Cited

U.S. PATENT DOCUMENTS 2,244,064 A * 6/1941 Hodge ..... B21D 51/24 219/137 R
3,656,518 A * 4/1972 Aronson ..... B65B 1/16 141/1
(Continued)

FOREIGN PATENT DOCUMENTS

JP 2005-291514 A 10/2005
JP 2010-236775 A 10/2010
JP 2011-242080 A 12/2011

OTHER PUBLICATIONS

International Search Report; PCT/JP2013/000287; Apr. 23, 2013.
Written Opinion of the International Searching Authority; PCT/JP2013/000287; Apr. 23, 2013.

*Primary Examiner* — Michael David
(74) *Attorney, Agent, or Firm* — Studebaker & Brackett PC

(57) ABSTRACT

A blast treatment method for blasting an object includes: a step in which an explosive is detonated inside a pressure vessel (30) which has an elasto-plastic metal, thereby imparting to the pressure vessel (30) an initial load wherein the primary and secondary stress generated in at least a portion of the pressure vessel becomes high enough to be in a plastic region exceeding the elastic region, thereby generating a shakedown state in the pressure vessel (30); and a subsequent step in which a treatment explosive (50) is detonated within the pressure vessel (30), thereby blasting the object (10).

6 Claims, 4 Drawing Sheets

(51) Int. Cl.

| | |
|---|---|
| ***F42D 3/00*** | (2006.01) |
| ***F42D 5/045*** | (2006.01) |
| ***B30B 1/00*** | (2006.01) |
| ***C21D 7/10*** | (2006.01) |
| ***C21D 9/00*** | (2006.01) |
| *B21D 26/08* | (2006.01) |

(52) U.S. Cl.
CPC ..... *F42B 33/06* (2013.01); *F42D 3/00* (2013.01); *F42D 5/045* (2013.01); *B21D 26/08* (2013.01)

(58) Field of Classification Search
USPC ..... 86/50
See application file for complete search history.

(56) References Cited

U.S. PATENT DOCUMENTS 4,055,247 A * 10/1977 Benedick ..... F42B 39/14 206/3
5,654,053 A * 8/1997 Crane ..... B32B 5/18 206/3
5,668,342 A * 9/1997 Discher ..... F42B 33/06 102/293
6,196,107 B1 * 3/2001 Hoffman ..... F42B 39/14 206/3
6,341,708 B1 * 1/2002 Palley ..... B65D 88/14 206/3
6,644,165 B1 * 11/2003 King ..... F42D 5/045 86/50
6,991,124 B1 * 1/2006 Palley ..... B65D 88/14 220/1.5
7,185,778 B1 * 3/2007 Palley ..... B65D 88/14 220/1.5
7,497,165 B2 * 3/2009 Fujiwara ..... C06B 21/0091 102/293
7,628,137 B1 * 12/2009 McAlister ..... F02M 21/026 123/297
8,387,503 B2 * 3/2013 Lesage ..... F42D 5/04 102/275.1
8,464,624 B2 * 6/2013 Asahina ..... C06B 21/0091 588/403
8,468,945 B2 * 6/2013 Koide ..... C06B 21/0091 102/293
8,573,125 B1 * 11/2013 Rossow ..... F42D 5/05 102/303
9,027,453 B2 * 5/2015 Ueda ..... F42B 33/06 86/50
2006/0076350 A1 * 4/2006 Weerth ..... B65D 88/14 220/88.1
2007/0029321 A1 * 2/2007 Palley ..... B65D 88/14 220/88.1
2007/0144637 A1 * 6/2007 Fujiwara ..... C06B 21/0091 149/109.6
2007/0151437 A1 7/2007 Fujiwara et al.
2009/0081928 A1 * 3/2009 Fujiwara ..... F42D 5/045 451/38
2009/0131733 A1 * 5/2009 Asahina ..... F42B 33/06 588/403
2010/0292525 A1 * 11/2010 Matsunaga ..... C22B 7/002 588/412
2012/0017750 A1 1/2012 Koide et al.
2012/0017753 A1 * 1/2012 Asahina ..... C06B 21/0091 86/50
2012/0312147 A1 * 12/2012 Abbe ..... F42D 5/045 86/50
2013/0042890 A1 2/2013 Kitamura et al.
2014/0311327 A1 * 10/2014 Dunleavy ..... F41H 5/0478 89/36.02
2014/0311329 A1 * 10/2014 Dyke ..... F41H 5/0435 89/36.02
2014/0352568 A1 * 12/2014 Benson ..... F42B 39/002 102/331
2015/0308796 A1 * 10/2015 Allen ..... F42B 3/124 102/301
2016/0040962 A1 * 2/2016 Rossow ..... F41H 5/0442 89/36.02

* cited by examiner

METHOD FOR BLASTING OBJECT TO BE TREATED IN PRESSURE VESSEL

TECHNICAL FIELD

The present invention relates to a blast treatment method for blasting an object to be treated such as ammunition.

BACKGROUND ART

A substance comprising a steel bombshell and a burster or a chemical agent contained in the interior is known as ammunition (a cannonball, a bomb, a land mine, a sea mine, etc.) for military use.

As a method for treating such ammunition, a method of supplying the explosion energy of an explosive to ammunition in a sealable pressure vessel and thereby detonating a burster while a bombshell is destroyed is known. As the pressure vessel, a sufficiently robust vessel capable of enduring a high pressure generated inside the pressure vessel by the explosion of an explosive is used. The treatment method by detonation does not require dismantling work and hence can be applied to the treatment of not only well-preserved weapons but also weapons having been hardly disassemblable by aging deterioration, deformation, or the like. Moreover, in the case of treating a bomb having a chemical agent harmful to a human body, it has the advantage that almost all of the chemical agent can be decomposed without scattering the chemical agent in the atmosphere by creating an ultrahigh temperature field and an ultrahigh pressure field caused by the explosion of an explosive in a pressure vessel.

Such a treatment method is disclosed in Patent Literature 1 for example. The method of Patent Literature 1: includes, in a sealable pressure vessel, a step of placing an ANFO explosive around an object to be treated (hereinafter simply referred to as "an object" or "the object") and wrapping the ANFO explosive with a sheet-shaped explosive and a process of initiating explosion at a prescribed end of the sheet-shaped explosive, sequentially detonating the sheet-shaped explosive in a prescribed direction, and sequentially detonating the ANFO explosive in the prescribed direction in accordance with the detonation of the sheet-shaped explosive; thereby making it possible to supply the detonation energy of the ANFO explosive to the object to be treated and thereby blast the object while the burster is detonated.

As the design standard of a pressure vessel used for a blast treatment, the same standard as an ordinary static pressure vessel (a vessel subject to a high pressure for a long period of time) is used. Specifically, the pressure vessel is designed so that at least a primary stress generated at a structural part (a part excluding a local structural discontinuous part of the pressure vessel) may not exceed an elastic region when a load is applied. In other words, a load applied to the pressure vessel is set so that a primary stress generated at the structural part of the pressure vessel may fall within an elastic region.

A blast treatment using a pressure vessel as stated above is required to treat an object safely and reliably. Specifically, energy given to an object is required to be increased while a pressure vessel is prevented from giving excessive plastic deformation and being broken when the object is blasted. To enlarge the size of a pressure vessel and increase the elastic limit load of the pressure vessel for that purpose however causes the cost and the necessary space to increase conspicuously.

CITATION LIST

Patent Literature

Patent Literature 1; Japanese Unexamined Patent Application Publication No. 2005-291514

SUMMARY OF INVENTION

An object of the present invention is to provide a blast treatment method that uses a pressure vessel and can treat an object reliably while the pressure vessel is prevented from being enlarging the size and generating excessive plastic deformation.

In order to attain the object, the present inventors have focused attention on a phenomenon called a shakedown state. The phenomenon is a phenomenon of: increasing an elastic limit load (maximum load in an elastic region) to an initial load when the initial load is given to a metal having elasto-plasticity to the extent that a stress generated in the metal reaches an (original) plastic region under specific conditions; and successively making the metal behave as if a load stays in an elastic region even when the load is applied to the metal to the extent that the stress of the metal reaches the original plastic region. The present invention is made by utilizing the phenomenon and provides a method for blasting an object. The method includes a step of preparing a pressure vessel that comprises a metal having elasto-plasticity, has a shape allowing an object to be contained in a closed state, and has an inner circumferential surface to receive detonation energy generated when the object is blasted in the contained state; a step of giving an initial load to the extent that the sum of a primary stress and a secondary stress generated in the pressure vessel exceeds an elastic limit and reaches a plastic region at least at a part of a structural part excluding a local structural discontinuous part of the pressure vessel and generating a shakedown state in the pressure vessel by containing an explosive to give an initial load in the pressure vessel, sealing the pressure vessel, and detonating the explosive to give the initial load; and a step of blasting the object in the pressure vessel by containing the object treated and a treatment explosive in the pressure vessel after the initial load is given, sealing the pressure vessel, and detonating the treatment explosive to the extent that a load smaller than the initial load is applied to the pressure vessel.

As stipulated also in JIS B 0190, "a local structural discontinuous part" means a part excluding an overall structural discontinuous part, namely, a local structural discontinuous part is a part causing a stress or a strain affecting a structurally relatively narrow part but not significantly affecting an overall stress or strain distribution to increase, from a structurally discontinuous part, namely a part where the shape or the material changes drastically; and for example includes a fillet welded part between a body consisting of a pressure vessel and a support to support the body, another round part having a small radius, a small weld-attached part, etc. In contrast, the overall structural discontinuous part means a part causing a structurally relatively wide part to be influenced from the previously mentioned structural discontinuous parts; and for example includes a joint between a head (lid) and a body, a joint between a flange and a body, a joint between shell plates having different diameters or different plate thicknesses, etc.

DESCRIPTION OF EMBODIMENTS

Embodiments of a blast treatment method according to the present invention are explained hereunder in reference to the drawings.

Figure 1:
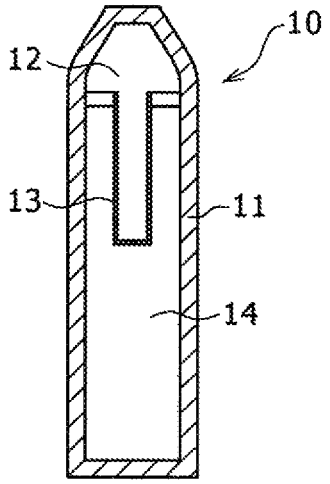
FIG. 1 is a longitudinal sectional view of a bomb that is an example of an object to be treated.

FIG. 1 is a schematic sectional view of a bomb 10 that is an example of an object to be treated (hereinafter simply referred to as "an object" or "the object") blasted by the blast treatment method. The bomb 10 comprises a cylindrical bombshell 11 extending in a prescribed direction, a steel burster tube 13 contained inside the bombshell 11, a burster 12 contained inside the burster tube 13, and a chemical agent 14 contained between the bombshell 11 and the burster tube 13. In the bomb 10, the bombshell 11 is destroyed as the burster 12 is detonated by a blasting fuse not shown in the figure or the like and explodes and the chemical agent 14 scatters together with the fragments of the bombshell 11 in the environment.

In a blast treatment method according to the present embodiment, a bomb 10 is blasted by a treatment explosive in the state of sealing a pressure vessel 30 and thereby comes to be harmless. A method of blasting a bomb 10 in a pressure vessel has heretofore been known. In such a blast treatment by a treatment explosive, a pressure vessel vibrates for a long period of time (several hundred milliseconds) after explosion. Then the energy absorbed by sound and the deformation of the pressure vessel, the vibration, and others balance with the explosion energy of the treatment explosive generated instantaneously at the explosion. Meanwhile, in a pressure vessel used in such a static state as storing a high pressure gas, a load caused by the inner pressure of the pressure vessel always balances with a stress generated in the pressure vessel. In this way, the relationship between a pressure vessel and a load when the pressure vessel is used for blast treatment is different from the relationship between a pressure vessel and a load when the pressure vessel is used statically.

A standard for a pressure vessel used statically however has heretofore been applied to the design standard for a pressure vessel used for blast treatment. Specifically, a conventional pressure vessel has been designed so that a primary stress generated by blast treatment at the structural part of the pressure vessel, namely at the part excluding the local structural discontinuous part of the pressure vessel, may fall within an elastic region. That is, a conventional pressure vessel used for blast treatment has been designed so that a primary stress generated at the structural part of the pressure vessel may be not larger than a prescribed stress smaller than a yield strength (proof stress) $\sigma y$. Otherwise, a conventional pressure vessel has been designed so that a value estimated by multiplying a residual strain generated in the pressure vessel per a blast treatment by the operation number of treatments may be smaller than the allowable strain of the pressure vessel.

As a consequence, when energy given to such a bomb 10 as shown in FIG. 1 is to be increased in a pressure vessel in order to treat the bomb 10 reliably, it has heretofore been necessary to significantly increase the wall thickness and the size of the pressure vessel. In other words, a problem has been that sufficiently high energy cannot be given to the bomb 10 so that a load applied to a pressure vessel may fall within an elastic region. Further, when the operation number of treatments is tried to be increased in a certain pressure vessel, a residual strain generated in the pressure vessel per a blast treatment has to be reduced and so that the size increase of the pressure vessel or the suppression of a load applied to the pressure vessel per a blast treatment and thus energy given to a bomb 10 is required.

In view of the above, the present inventors have found the following. That is, it has been found that, by using an elasto-plastic metal for a pressure vessel used for blast treatment and applying an initial load to the pressure vessel by the explosion of an explosive to the extent that a primary and secondary stress, namely the sum of a primary stress and a secondary stress, generated in the pressure vessel reaches a plastic region, it is possible to generate a shakedown state in the pressure vessel, thereby increasing the elastic limit load of the pressure vessel, applying a larger load to the pressure vessel while the accumulation of residual strain is avoided, and thus giving larger energy to a bomb 10. The present blast treatment method is based on the findings and makes it possible to treat a bomb 10 efficiently by using a pressure vessel being in the state of a shakedown beforehand. Here the shakedown state is the phenomenon of increasing the elastic limit load of a metal to an initial load and expanding the elastic region of the metal to a region that is originally a plastic region when an initial load is given to an elasto-plastic metal under a specific condition to the extent that a primary and secondary stress reaches the plastic region.

Figure 2:
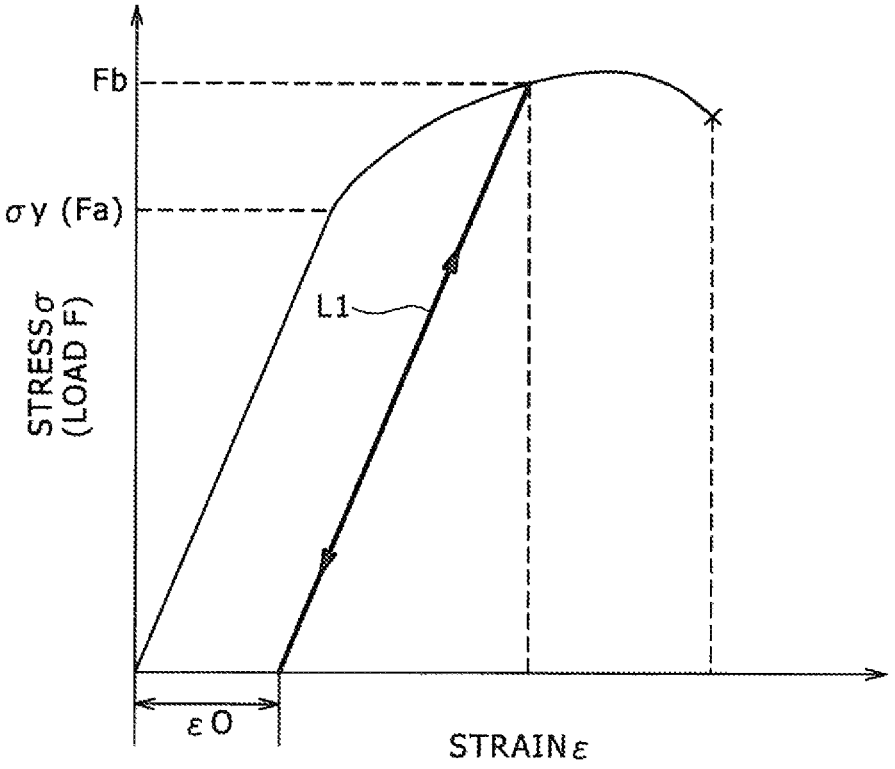
FIG. 2 is a stress-strain curve for explaining a shakedown state.

In the stress (load)-strain curve shown in FIG. 2, when an initial load Fb larger than an original elastic limit load Fa and is included in a plastic region is applied and thereby a shakedown state is generated in a pressure vessel 30, the elastic limit load of the pressure vessel 30 shifts to the initial load Fb larger than the original elastic limit load Fa. Further, after the initial load is removed, an initial plastic strain $\epsilon O$ is generated in the pressure vessel 30. Then, when a load not larger than the initial load is given after the initial load is removed, the pressure vessel 30 deforms elastically, the stress and strain shift along the straight line L1, and thereby a residual strain $\epsilon$ after the removal of the load is prevented from increasing.

Table 1 shows the result of the investigation carried out by the present inventors on the transition of the residual strain of a pressure vessel after a shakedown state is generated. Specifically, the maximum strain of a pressure vessel generated when 75 kg of a TNT (trinitrotoluene) explosive is detonated and a shakedown state is generated in the pressure vessel is investigated. Successively, 40.5 kg and 60 kg of TNT explosives are detonated in sequence and the increments of the maximum values of the residual strains of the pressure vessel 30 generated after the respective explosions are investigated.

The residual strains in Table 1 show the increments of the residual strains generated after respective explosions. The ratio of residual strain in Table 1 represent the proportions of the increments of the residual strains generated at the subsequent (second and third) explosions to the residual strain generated at the first explosion. As shown in Table 1, the first increment of the residual strain generated when 75 kg of the TNT explosive is detonated shows a very high value of $8{,}642\times10^{-6}$. In contrast, the successive increments of the residual strains accompanying the explosions of 40.5 kg of the TNT explosive and 60 kg of the TNT explosive are very small values of $77\times10^{-6}$ and $-34\times10^{-6}$ respectively and it is shown that the increase and accumulation of the residual strains are suppressed after the shakedown state is generated. In this investigation, a vessel having a structure mentioned shown in FIGS. 3 and 4 is used as the pressure vessel, the elastic limit load Fa is smaller than the load generated by 75 kg of the TNT explosive, and the shakedown state is generated in the pressure vessel by the explosion of 75 kg of the TNT explosive.

TABLE 1

| | TNT explosive (kg) | Residual strain | Ratio of residual strain |
|---|---|---|---|
| First explosion | 75 | $8642 \times 10^{-6}$ | 1 |
| Second explosion | 40.5 | $77 \times 10^{-6}$ | $-0.0089\approx0$ |
| Third explosion | 60 | $-34 \times 10^{-6}$ | $0.0039\approx0$ |

Figure 3:
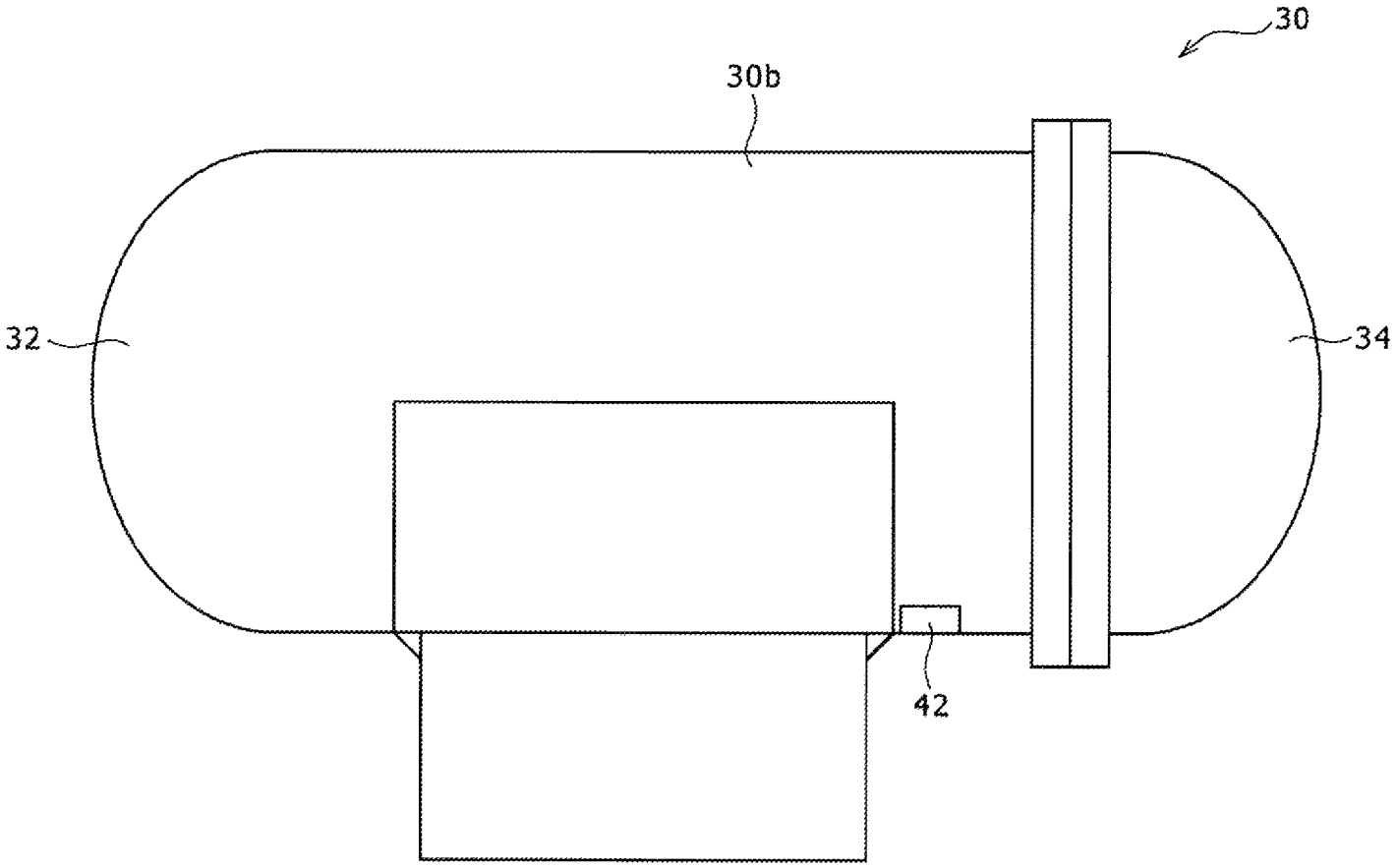
FIG. 3 is a schematic side view of a pressure vessel used in a blast treatment method according to an embodiment of the present invention.
Figure 4:
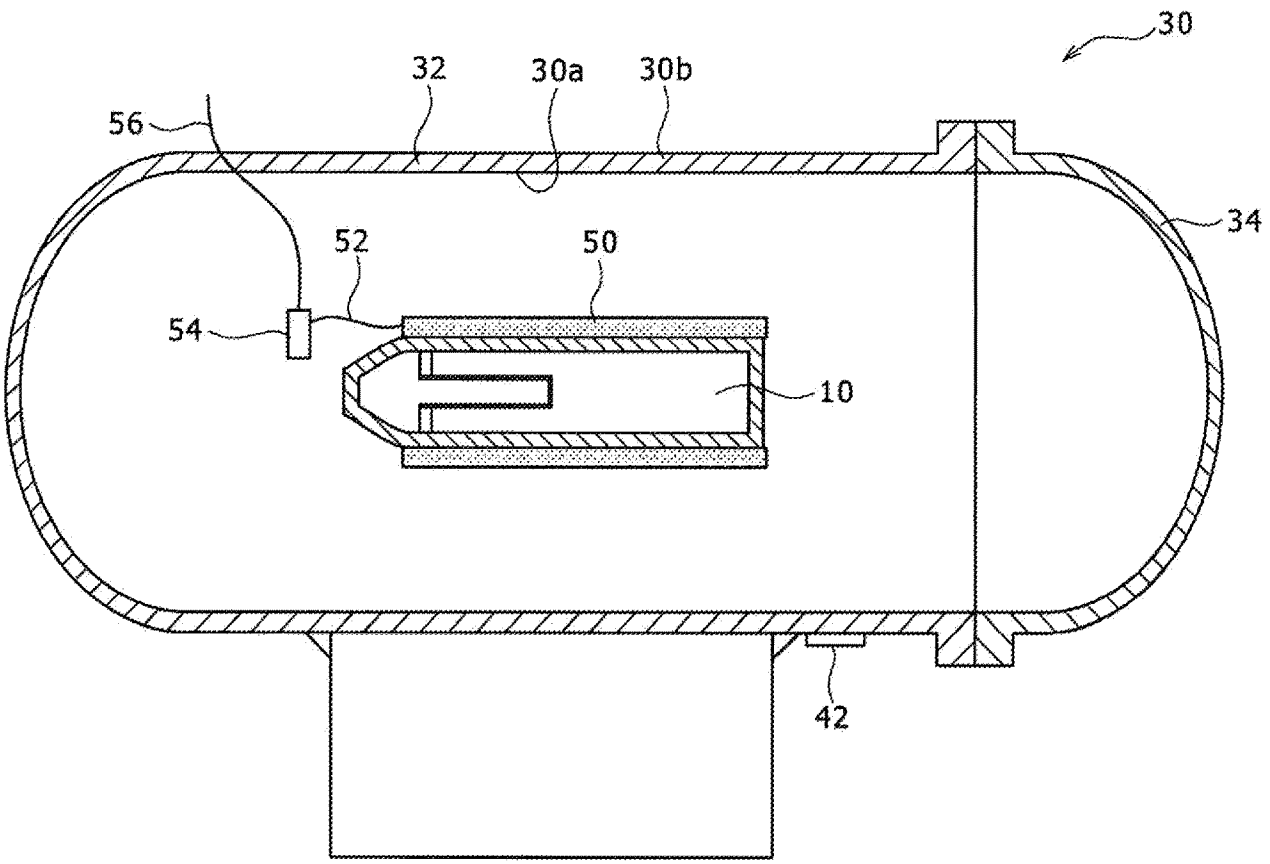
FIG. 4 is a sectional side view of the pressure vessel shown in FIG. 3.

A blast treatment device used in a blast treatment method according to the present embodiment is hereunder explained in reference to FIGS. 3 and 4. The blast treatment device comprises a pressure vessel 30, a treatment explosive 50, a detonating cord 60, and a detonating device 70. FIG. 3 is a side view showing an example of the pressure vessel 30. FIG. 4 is a longitudinal sectional view showing the pressure vessel 30 in the state of containing a bomb 10 and others inside.

The pressure vessel 30 is divided into a vessel part 32 and a detachable lid part 34. The pressure vessel 30 comprises an elasto-plastic metal. In the present embodiment, the pressure vessel 30 comprises a 3.5%-nickel steel. The vessel part 32 has an opening and contains the bomb 10 and others which are carried in through the opening. In the present embodiment, the vessel part 32 has a nearly cylindrical shape and the opening is formed at an end thereof in the axial direction. The lid part 34 opens and closes the opening of the vessel part 32. The lid part 34 seals the vessel part 32 and thus the inside of the pressure vessel 30 by closing the opening. The lid part 34 according to the present embodiment has a hollow semispherical shape. The lid part 34 has a ring-shaped end surface tightly attached to the end surface of the opening of the vessel part 32 when the opening is closed. In the state of closing the opening of the vessel part 32 with the lid part 34, the spherical space inside the lid part 34 communicates with the space inside the vessel part 32 and the inner circumferential surface of the lid part 34 nearly levels with the inner circumferential surface of the vessel part 32.

The bomb 10 is contained in the vessel part 32, the opening of the vessel part 32 is closed with the lid part 34, and detonation is carried out in the state of sealing the interior of the pressure vessel 30. On that occasion, an inner circumferential surface 30*a* of the pressure vessel 30, namely the inner circumferential surface of the vessel part 32 and the inner circumferential surface of the lid part 34, receives the energy generated at the detonation. In the example shown in FIG. 4, the bomb 10 is suspended nearly in the center of the pressure vessel 30 with a suspension member not shown in the figure and a strain gage 42 for measuring the strain of the pressure vessel 30 is attached to an outer circumferential surface 30*b* of the pressure vessel 30. The strain gage 42 is attached to a part where a strain generated at blast treatment is estimated to be relatively large in the structural part of the pressure vessel 30 on the basis of the result of computer simulation carried out beforehand.

The treatment explosive 50 blasts the bomb 10 by giving the detonation energy to the bomb 10. In the present embodiment, a sheet-shaped explosive is used as the treatment explosive 50. The sheet-shaped treatment explosive 50 detonates in the state of being wrapped around the bomb 10 and gives the detonation energy to the bomb 10 in a focused manner.

The detonating cord 52 is used for detonating the treatment explosive 50 and has a first end connected to the treatment explosive 50 and a second end connected to an electric detonator 54 that is a detonating device. A firing cable 56 extends from the electric detonator 54 and is connected to a blasting machine not shown in the figure. When the blasting machine is operated, the electric detonator 54 detonates the detonating cord 52. The detonation of the cord 52 progresses toward the treatment explosive side, which gives the detonation energy to the treatment explosive 50, and thereby detonates the treatment explosive.

The type of the treatment explosive 50 is not limited to the aforementioned type as long as it can blast the bomb 10. The electric detonator 54 may be any one as long as it can detonate the treatment explosive 50 and may be attached directly to the treatment explosive 50 without using the detonating cord 52.

Figure 5:
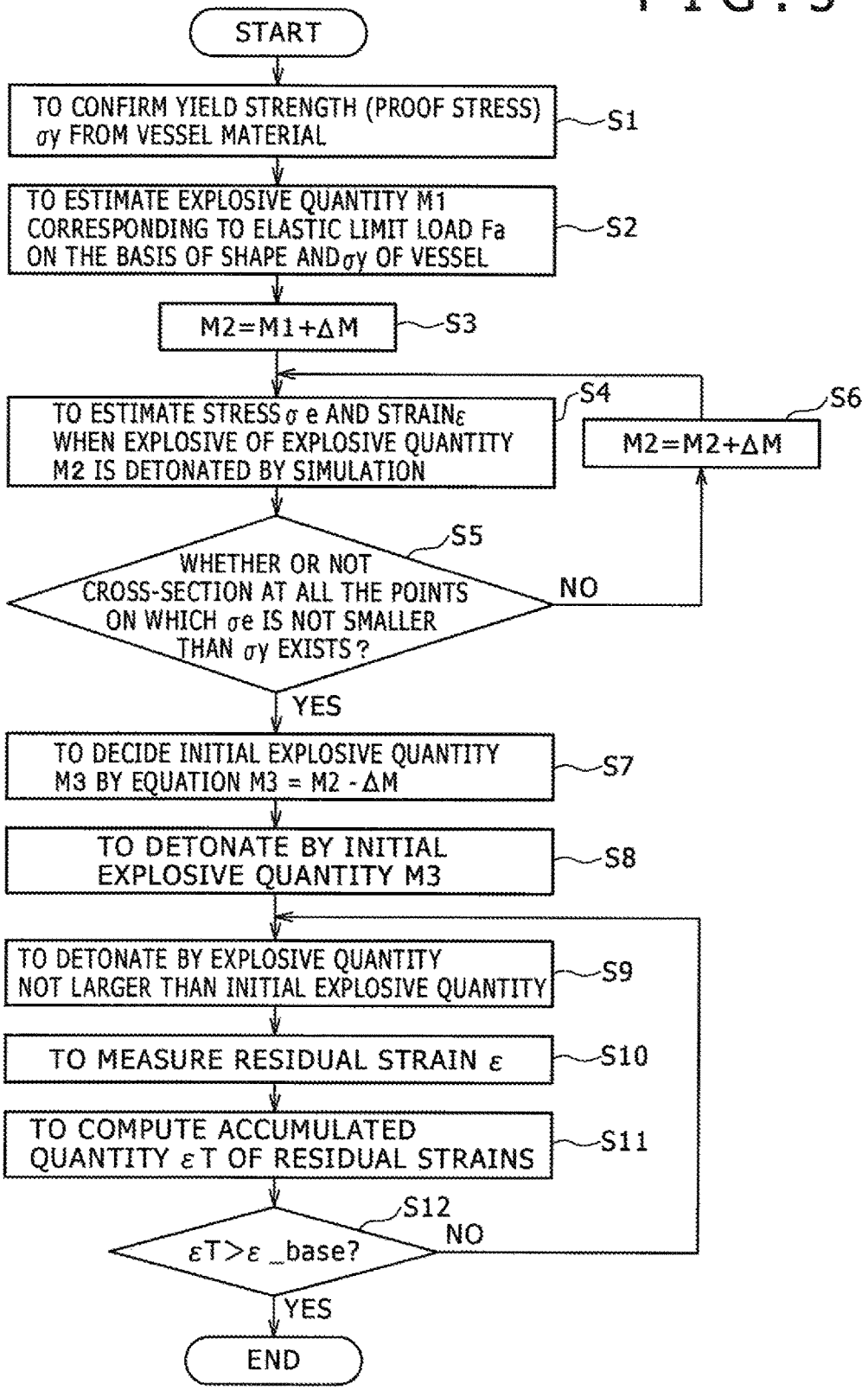
FIG. 5 is a flowchart showing a concrete procedure of a blast treatment method according to an embodiment of the present invention.

The procedure of a blast treatment method according to the present embodiment is hereunder explained in reference to the flowchart of FIG. 5 and the stress-strain curve of FIG. 2. The blast treatment method includes the following processes.

1) Process of Deciding Quantity of Initial Explosive

In the process, Steps S1 to S7 shown in the flowchart of FIG. 5 are carried out and an initial load given firstly to a pressure vessel 30 and the quantity of an explosive to give an initial load (initial explosive quantity M3) that can give the initial load are decided.

The initial load is decided so that the primary and secondary stress generated at each of the cross-sections of the structural part of the pressure vessel 30 by giving the initial load may be a stress in a plastic region exceeding an elastic region (a stress not smaller than a yield strength (proof stress) $\sigma y$). In other words, namely the initial load is decided so as to be larger than the original elastic limit load Fa of the structural part of the pressure vessel 30. Here, when the equivalent stresses $\sigma e$ at all the points on an arbitrary cross-section of the structural part of the pressure vessel 30 are not smaller than the yield strength (proof stress) $\sigma y$, the significantly large deformation will generate in the component including its cross-section. In the present embodiment therefore, the value of the initial load is decided so that, on all the cross-sections of the structural part of the pressure vessel 30, an equivalent stress $\sigma e$ at a part on each of the cross-sections may be not smaller than the yield strength (proof stress) $\sigma y$ and an equivalent stress $\sigma e$ at another part may be suppressed to a stress smaller than the yield strength $\sigma y$. As a result, a cross-section at all the points on which the equivalent stresses $\sigma e$ are not smaller than the yield strength $\sigma y$ is prevented from being generated.

Specifically, at Step S1, a yield strength (proof stress) $\sigma y$ is confirmed on the basis of the material of a pressure vessel 30. For example, the yield strength $\sigma y$ of a 3.5%-nickel steel used for a pressure vessel 30 in the present embodiment is 260 MPa.

At Step S2, an elastic limit load Fa at the structural part of the pressure vessel 30 is estimated on the basis of the yield strength σy and the shape of the pressure vessel 30. The elastic limit load Fa is a load given when a primary and secondary stress generated at the structural part of the pressure vessel 30 comes to be the yield strength σy. Specifically, the relationship between the quantity of an explosive and the primary and secondary stress generated at the structural part of the pressure vessel 30 when an explosive is detonated in the pressure vessel 30 is estimated with the use of computer simulation analysis software having a capability of numerical computations. More specifically, an explosive quantity M1 (hereunder referred to as an elastic limit explosive quantity) of an explosive to give an initial load corresponding to the elastic limit load Fa given when the primary and secondary stress generated at the structural part of the pressure vessel 30 comes to be the yield strength σy is estimated by repeating the computer analysis several times. For example, when a pressure vessel 30 being used at the test according to Table 1, having the structure shown in FIGS. 3 and 4, and comprising a 3.5%-nickel steel is used and a TNT explosive is used as the explosive to give the initial load, the elastic limit explosive quantity M1 of the TNT explosive that is the explosive to give the initial load necessary for applying the elastic limit load Fa to the pressure vessel 30 is estimated to be 50 kg.

At Step S3, the quantity obtained by adding a reference increment ΔM to the elastic limit explosive quantity M1 computed at Step S2 is decided as a temporary explosive quantity M2 and, at Step S4, an equivalent stress σe generated at the structural part of the pressure vessel 30 when the temporary explosive quantity M2 computed at Step S3 explodes in the pressure vessel 30 is computed (hereunder the equivalent stress σe computed at Step S3 is referred to as an explosion equivalent stress occasionally). The explosion equivalent stress σe, for example, can be computed by a simulation on the basis of a pressure applied to the inner circumferential surface of the pressure vessel 30 when the explosive of the temporary explosive quantity M2 explodes and the structure of the pressure vessel 30 and the pressure can also be computed by a simulation.

At Step S5, for all cross-sections of the structural part of the pressure vessel 30, an explosion equivalent stress σe is compared with a yield strength σy at each point on each of the cross-sections and whether or not a cross-section at all the points on which the explosion equivalent stresses σe are not smaller than the yield strength σy exists is judged. When the judgment at Step S5 is NO, namely when a cross-section at all the points on which the explosion equivalent stresses σe are not smaller than the yield strength σy does not exist, the procedure advances to Step S6. When the judgment at Step S5 is YES in contrast, namely when a cross-section at all the points on which the explosion equivalent stresses σe are not smaller than the yield strength σy exists, the procedure advances to Step S7.

At Step S6, the temporary explosive quantity M2 is renewed to a larger quantity. Specifically, a quantity obtained by adding the reference increment ΔM to the previously decided temporary explosive quantity M2 is decided as a renewed temporary explosive quantity M2. Then the procedure goes back to Step S4. That is, in the present embodiment, the temporary explosive quantity M2 is increased until the judgment comes to be YES at Step S5.

At Step S7 after judged as YES at Step S5, an initial explosive quantity M3 is decided so as to be a value obtained by subtracting the reference increment ΔM from the temporary explosive quantity M2. That is, the last value of the explosive quantity M2 before the final renewal at Step S6 is decided as the initial explosive quantity M3. The initial explosive quantity M3 thus decided is larger than the elastic limit explosive quantity M1 and is a value slightly smaller than a quantity at which the explosion equivalent stresses σe at all the points on all cross-sections of the structural part of the pressure vessel 30 is not smaller than the yield strength σy. The initial explosive quantity M3 is decided so as to be not smaller than 50 kg to not larger than 75 kg in terms of a TNT explosive for example.

2) Process of Giving Initial Load

At the process, Step S8 is carried out. That is, an initial load is given to the pressure vessel 30 by detonating an explosive to give the initial load of the initial explosive quantity M3 decided at the initial explosive quantity decision process in the pressure vessel 30. Specifically, the explosive to give the initial load of the initial explosive quantity M3 is carried in the vessel part 32 of the pressure vessel 30. An electric detonator 54 is connected to the explosive to give the initial load beforehand and a firing cable 56 extends from the electric detonator 54. After the explosive to give the initial load is carried in, the pressure vessel 30 is sealed with a lid part 34 in the state of extracting the firing cable 56 outside the pressure vessel 30. Successively, the electric detonator 54 detonates a detonating cord 52 and thus the explosive by operating a detonator and detonates the explosive to give the initial load in the pressure vessel 30 of a sealed state. By the detonation of the explosive to give the initial load of the initial explosive quantity M3, an initial load Fb not smaller than an original elastic limit load Fa is applied to the structural part of the pressure vessel 30 and a shakedown state is generated in the pressure vessel 30.

In the process giving the initial load, it is also possible to detonate an explosive in the state of containing a bomb 10 in a pressure vessel 30. By doing so, it is possible to treat the bomb 10 while an initial load Fb is applied to the pressure vessel 30. In the case however, at the process of giving the initial load, the explosion load of an explosive contained in the bomb 10 is also applied to the pressure vessel 30 and hence the initial explosive quantity M3 of the explosive to give the initial load should be decided in consideration of the load.

3) Treatment Process

During the process, Step S9 is carried out. That is, the bomb 10 is blasted by a treatment explosive 50.

Specifically, firstly the quantity of the treatment explosive 50 is decided so that a load given to the pressure vessel 30 at the time of explosion may be not larger than an initial load Fb and the treatment explosive 50 of the quantity is prepared. In the present embodiment, as the treatment explosive 50, an explosive of the same kind as the explosive used at the process giving the initial load is used. Consequently, the quantity of the treatment explosive 50 is decided so as to be a quantity not larger than the initial explosive quantity M3.

Successively, the treatment explosive 50 and a bomb 10 are carried in the vessel part 32 of the pressure vessel 30. In the present embodiment, the bomb 10 is mounted at the bottom of the vessel part 32 in the state of wrapping the treatment explosive 50 around the bomb 10. The bomb 10 may also be suspended at a position in the center of the pressure vessel 30 for example. An electric detonator 54 is connected to the treatment explosive 50 beforehand and the pressure vessel 30 is sealed with the lid part 34 in the state of extracting a firing cable 56 extending from the electric detonator 54 toward the exterior of the pressure vessel 30. Successively, by operating a detonating device, the electric detonator 54 detonates a detonating cord 52 and thus the treatment explosive 50. The detonation energy of the treatment explosive 50 is added to the bomb 10 and blasts the bomb 10. Specifically, a bombshell 11 is destroyed, a burster 12 detonates, a chemical agent 14 decomposes by being exposed to a high temperature and a high pressure, and thereby the bomb 10 comes to be harmless.

A shakedown state is generated in the pressure vessel 30 during the process giving the initial load. A load given at the treatment process is controlled under the initial load Fb given at the process giving the initial load. As a result, the pressure vessel 30 does not plastically deform but elastically deforms by the blasting of the bomb 10 and a residual stain is prevented from increasing.

In the successive Step S10, a residual strain $\epsilon$ generated in the pressure vessel 30 by the blasting of the bomb 10 caused by the detonation of the treatment explosive 50 is measured with a strain gage (strain measurement process).

In the successive Step S11, the accumulated quantity $\epsilon T$ of the residual strains $\epsilon$ generated since the start of the treatment process is computed. Specifically, in the case of the first treatment process, the same value as the strain $\epsilon$ measured at Step S10 is computed as the accumulated quantity $\epsilon T$ of the residual strain. After the second treatment process in contrast, a value obtained by summing the residual strains $\epsilon$ measured at each treatment process is considered as the accumulated quantity $\epsilon T$ of the residual strains.

In the successive Step S12, whether or not the accumulated quantity $\epsilon T$ of the residual strains is not smaller than a predetermined reference quantity $\epsilon$_base is judged. When the judgment is YES, additional treatment of a bomb 10 in the pressure vessel 30 is not carried out and the treatment is finished instantaneously. In contrast, when the judgment is NO, namely when the accumulated quantity $\epsilon T$ of the residual strains caused by the treatment processes is smaller than the reference quantity $\epsilon$_base, the procedure returns to Step S9 and additional treatment of a bomb 10 is carried out in the pressure vessel 30.

By the blast treatment method explained above, a bomb 10 is treated in a pressure vessel 30 already having been in a shakedown state and having an increased elastic limit load so that a load applied to the pressure vessel 30 may be smaller than an increased elastic limit load. Accordingly, it is possible to treat the bomb 10 without plastically deforming the pressure vessel 30, thereby giving a large explosion energy by the bomb 10, and treating the bomb 10 reliably. Further, it is possible to treat bombs 10 several times without additional residual strain to be accumulated and treat the bombs 10 efficiently.

Meanwhile, in the present blast treatment method, an initial load is decided so as to take a value that makes it possible, on all the cross-sections of the structural part of a pressure vessel 30, to suppress an equivalent stress $\sigma e$ at least at a part on each of the cross-sections to a stress smaller than a yield strength (proof stress) $\sigma y$; namely a value that does not allow a cross-section at all the points on which the equivalent stresses $\sigma e$ is not smaller than the yield strength $\sigma y$ to exist. As a result, it is possible to prevent the possibility of the significantly large deformation of the component including its cross-section because the equivalent stresses $\sigma e$ at all the points on a cross-section of the structural part of the pressure vessel 30 comes to be not smaller than a yield strength (proof stress) $\sigma y$.

In addition, when the accumulated quantity $\epsilon T$ of the residual strains $\epsilon$ is smaller than a reference quantity $\epsilon$_base after a treatment process, the treatment process is pursued and thereby the destruction of the pressure vessel accompanying the accumulation of the residual strains $\epsilon$ can be avoided reliably.

Although, in the present embodiment, the value of an initial load is decided so that, on all the cross-sections of the structural part of a pressure vessel 30, an equivalent stress $\sigma e$ at a part on each of the cross-sections may be not smaller than a yield strength (proof stress) $\sigma y$ and an equivalent stress $\sigma e$ at another part may be suppressed to a stress smaller than the yield strength $\sigma y$, the present invention is not limited to this case. It is only necessary to decide an initial load so that a primary and secondary stress generated at least at a part of a structural part may exceed an elastic region.

Further, the shape of a pressure vessel is also not limited to the aforementioned shape. The material of a pressure vessel may be any material as long as the material is an elasto-plastic metal generating a shakedown state. Furthermore, an object by the present method is also not limited to the object described earlier.

In this way, the present invention makes it possible to provide a blast treatment method that uses a pressure vessel and can treat an object reliably without significantly enlarging a size of the pressure vessel and generating excessive plastic deformation. The method includes a step of preparing a pressure vessel that comprises a metal having elasto-plasticity, has a shape allowing an object to be contained in a closed state, and has an inner circumferential surface to receive detonation energy generated when the object to be treated is blasted in the contained state; a step of giving an initial load to the extent that the sum of a primary stress and a secondary stress generated in the pressure vessel exceeds an elastic limit and reaches a plastic region at least at a part of a structural part excluding a local structural discontinuous part of the pressure vessel and generating a shakedown state in the pressure vessel by containing an explosive to give an initial load in the pressure vessel, sealing the pressure vessel, and detonating the explosive to give the initial load; and a step of blasting the object in the pressure vessel by containing the object and a treatment explosive in the pressure vessel after the initial load is given, sealing the pressure vessel, and detonating the treatment explosive to the extent that a load smaller than the initial load is applied to the pressure vessel.

As stipulated also in JIS B 0190, "a local structural discontinuous part" means a part excluding an overall structural discontinuous part, namely a local structural discontinuous part causing a stress or a strain affecting a structurally relatively narrow part but not significantly affecting an overall stress or strain distribution to increase, from a structural discontinuous part, namely a part where the shape or the material changes drastically; and for example includes a fillet welded part between a body consisting of a pressure vessel and a support to support the body, another round part having a small radius, a small weld-attached part, etc. In contrast, an overall structural discontinuous part means a part causing a structurally relatively wide part to be influenced from the previously mentioned discontinuous part; and for example includes a joint between a head (lid) and a body, a joint between a flange and a body, a joint between shell plates having different diameters or different plate thicknesses, etc.

In the method, a pressure vessel comprises an elasto-plastic metal, an initial load is applied to the pressure vessel by the explosion of an explosive in the pressure vessel to the extent that a primary and secondary stress generated at the structural part of the pressure vessel reaches a plastic region, and thereby it is possible to generate an appropriate shakedown state in the pressure vessel and increase the elastic limit load of the pressure vessel. Then by carrying out the blast treatment of an object in the pressure vessel of the increased elastic limit load, it is possible to give a higher energy to the object in the pressure vessel without generating excessive plastic deformation in the treatment process and enlarging the size of the pressure vessel. That makes it possible to treat the object safely and reliably.

In the present invention, it is preferable to: detonate the treatment explosive to the extent that a load smaller than the initial load is applied to the pressure vessel at the treatment process; and carry out the treatment process several times after the process giving the initial load. In the method, a load applied to a pressure vessel is kept smaller than an initial load, namely an elastic limit load having increased in accordance with a shakedown state, at the treatment process, thereby the treatment process can be carried out in the range where the pressure vessel deforms elastically, and hence a significant increase of residual strain caused by the implementation of the treatment process can be avoided. Consequently, it is possible to carry out the treatment process several times while the significant damage of the pressure vessel accompanying the increase of the residual strain is avoided reliably. This increases the number of the treatment process and enhances the treatment efficiency.

The method further includes a strain measurement process to measure a residual strain at a predetermined measurement point in the structural part of a pressure vessel after a treatment process. It is preferable to continue the treatment process for another object when the specific condition that the accumulated quantity of the measured residual strains is smaller than a predetermined reference quantity is satisfied; and in contrast to prohibit the treatment process from continuing when the specific condition is unsatisfied. This makes it possible to avoid the significant damage or destruction of a pressure vessel more reliably.

Although it is concerned that the significant large deformation of the component generates and leads to the significant damage when the equivalent stresses at all the points on the cross-section are not smaller than a yield strength, the significant damage of a pressure vessel can be avoided more reliably by setting an initial load so that, on all the cross-sections of the structural part of the pressure vessel, the stress at least at a part on each of the cross-sections may be smaller than a yield strength.

The invention claimed is:

1. A method for blasting an object to be treated, including:

preparing a pressure vessel that comprises a metal having elasto-plasticity, has a shape allowing the object to be treated to be contained in a closed state, and has an inner circumferential surface to receive detonation energy generated when the object to be treated is blasted in a contained state;

giving an initial load to the pressure vessel to the extent that the sum of a primary stress and a secondary stress generated in the pressure vessel exceeds an elastic limit and reaches a plastic region at least at a part of a structural part excluding a local structural discontinuous part of the pressure vessel and generating a shakedown state to the pressure vessel by containing an explosive, sealing the pressure vessel, and detonating the explosive to give the initial load; and blasting the object to be treated in the pressure vessel by containing the object to be treated and a treatment explosive in the pressure vessel after the initial load is given, sealing the pressure vessel, and detonating the treatment explosive.

2. A method according to claim 1, wherein the treatment process includes a process of detonating the treatment explosive to the extent that a load smaller than the initial load is applied to the pressure vessel and the treatment process is carried out several times after the process giving the initial load.

3. A method according to claim 2, wherein: the method further includes a strain measurement process to measure a residual strain at a predetermined measurement point in the structural part of the pressure vessel after the treatment process; and the treatment process for another object to be treated is continued when the specific condition that the accumulated quantity of the measured residual strains is smaller than a predetermined reference quantity is satisfied and in contrast the treatment process is prohibited from continuing when the specific condition is unsatisfied.

4. A method according to claim 1, wherein the initial load is set so that, on all the cross-sections of the structural part of the pressure vessel, the stress at least at a part on each of the cross-sections may be smaller than a yield strength.

5. A method according to claim 2, wherein the initial load is set so that, on all the cross-sections of the structural part of the pressure vessel, the stress at least at a part on each of the cross-sections may be smaller than a yield strength.

6. A method according to claim 3, wherein the initial load is set so that, on all the cross-sections of the structural part of the pressure vessel, the stress at least at a part on each of the cross-sections may be smaller than a yield strength.

* * * * *